United States Patent [19]

Jones

[11] 4,116,593

[45] Sep. 26, 1978

[54] LUBRICANT METERING SYSTEM FOR ROTARY PISTON MECHANISM

[76] Inventor: Charles Jones, 208 Forest Dr., Hillsdale, N.J. 07642

[21] Appl. No.: 818,412

[22] Filed: Jul. 25, 1977

Related U.S. Application Data

[62] Division of Ser. No. 739,521, Nov. 8, 1976, abandoned.

[51] Int. Cl.[2] ..... F01C 19/08; F01C 21/04

[52] U.S. Cl. ..... 418/94; 418/142

[58] Field of Search ..... 418/91, 94, 142

[56] References Cited

U.S. PATENT DOCUMENTS

| | | | |
|---|---|---|---|
| 3,718,412 | 2/1973 | McCormick | 418/142 |
| 3,869,229 | 3/1975 | Kurio | 418/142 |

FOREIGN PATENT DOCUMENTS

| | | | |
|---|---|---|---|
| 48-50833 | 3/1972 | Japan | 418/142 |

*Primary Examiner*—John J. Vrablik

[57] ABSTRACT

The lubricant metering system is for a rotary piston mechanism of the Wankel type and provides for by-passing a predetermined amount of lubricant past the oil seal ring carried by the rotary piston. The by-pass is one or more radially extending recesses of small total flow area in the contact surface of the oil seal ring, each of the recesses being in the nature of a scratch.

3 Claims, 5 Drawing Figures

FIG. 3
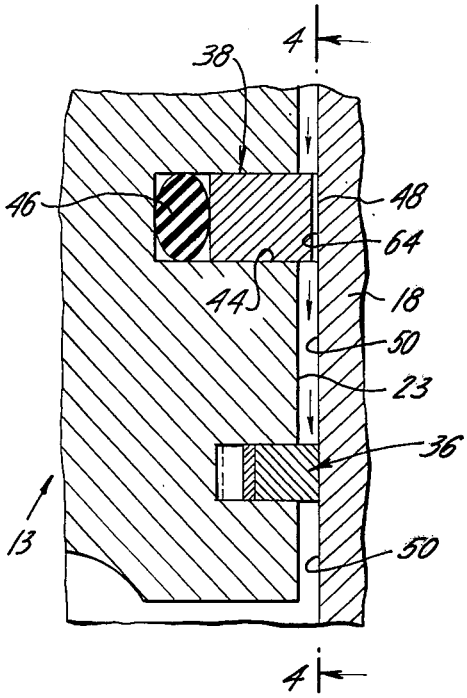
FIG. 4
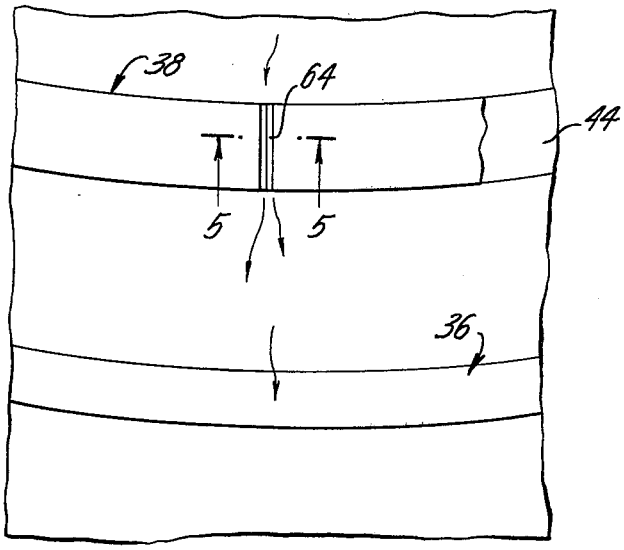
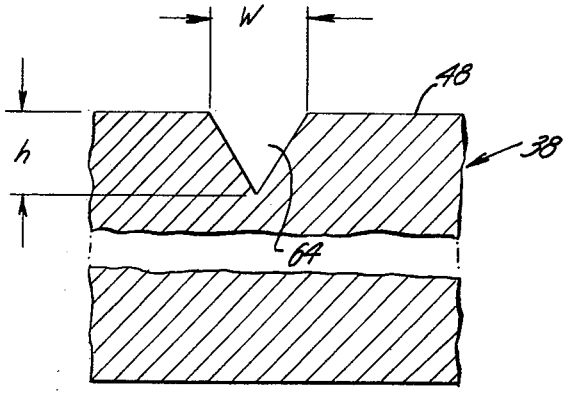
FIG. 5

LUBRICANT METERING SYSTEM FOR ROTARY PISTON MECHANISM

This application is a divisional application of parent application, Ser. No. 739,521 filed Nov. 8, 1976, now abandoned.

This invention relates to lubricating systems for rotary piston mechanisms of the Wankel type and, more specifically, to a lubricant metering means for such mechanisms.

In rotary piston mechanisms of the Wankel type, it is essential to lubricate the housing surfaces contacted by apex seal assemblies, gas seal strips and oil seal rings. To achieve lubrication of those surfaces, many lubricant systems have been designed. Some systems provide means for introducing oil into the air stream entering the working chambers as is exemplified in the following U.S. patents:

U.S. Pat. No. 3,193,053 to Scherenberg et al, 7/6/65;
U.S. Pat. No. 2,400,814 to Duerr, Jr., 2/8/49;
U.S. Pat. No. 3,923,435 to Jones, 12/2/75.

Other systems provide for flow of lubricant to grooves or holes in the peripheral surface defining the housing cavity, as exemplified in the U.S. patents: U.S. Pat. No. 3,420,214 to Bensinger et al dated Jan. 7, 1969; U.S. Pat. No. 3,245,386 to Bentele dated Apr. 12, 1966; U.S. Pat. No. 3,844,691 to Dobler dated Oct. 29, 1974; and U.S. Pat. No. 3,771,903 to King et al dated Nov. 13, 1973. Still other known lubricant metering systems have included injecting lubricant into the carburetor or fuel pump as is shown in the U.S. patent to Nallinger, U.S. Pat. No. 3,140,700 dated July 14, 1964. All of these various known systems and means for lubricating the surfaces defining the working chambers of a rotary mechanism are relatively complex and expensive. Therefore, in small engine applications, as for example, in lawnmowers, chain saws and the like, such expensive systems may reduce the competitive advantages of the rotary piston mechanism over the conventional small reciprocating piston engines.

Another lubricating concept is disclosed in the patent to Lamm, U.S. Pat. No. 3,215,340 dated Nov. 2, 1965. This patent relates to the lubrication of the abutting surfaces of multi-blade apex seals by providing a plurality of small grooves in the outer-lead blade to by-pass lubricant from the peripheral housing wall to the area behind the outer-lead blade. This system, of course, does not solve the problem of lubricating the end wall surfaces of the housing which are engaged by the oil ring seals and side seal strips from a source of oil under a positive pressure.

In another type of lubricant system, as exemplified in Japanese Pat. No. 47-50883 dated 1972 to Nippon Piston Ring, the oil seal rings are split to define, between the adjacent spaced ends, passages for the flow of lubricant inwardly toward the mainshaft and the central area of the rotor. Obviously, this arrangement is not for metering small quantities of lubricant to the side and apex seals.

In a still further concept disclosed in Japanese Pat. No. 46-20601 dated 1971 to Toyo Kogyo, an oil groove is provided in an end housing wall which is straddled by the oil seal trace to communicate the inner central area of the rotor with the "no wear triangle" which is an area bounded by the trace line of the inner edge of the side seals and the trace line of the outer edge of the oil seal ring. The disdvantage of this concept is that, for proper metering of small quantities of oil, it is difficult to size and fabricate the groove in the large flat surface of the side housing wall to provide the desired flow area. Furthermore, as the oil seal wears, the groove functions to meter greater and greater quantities into the "no wear triangle" which is contrary to the desirability of decreasing such metered oil flow as the seal wears and becomes less effective. In addition, if the side wall surface is refinished so must the grooves by remachined to provide the desired flow area.

It is, therefore, an object of this invention to provide, in a rotary piston mechanism, a lubricant metering system which is simple and inexpensive.

It is another object of the present invention to provide, in a rotary piston mechanism, a lubricant metering system for lubricating the inner housing surfaces, which system is effective yet automatically avoids excessive lubrication in the working chambers.

SUMMARY OF THE INVENTION

Accordingly, this invention contemplates a lubricant metering system for a rotary piston mechanism of the Wankel type. The mechanism has a housing comprising two end walls which are spaced apart by an intermediate wall having an inner surface of trochoidal shape and which defines therebetween a multi-lobe cavity. The mechanism also includes a piston or rotor consisting of opposite side faces, a plurality of flank portions and a hub portion is supported in the housing cavity at its hub portion on a mainshaft for planetary or orbital movement. The rotor and housing define therebetween a plurality of working chambers which successively expand and contract in volumetric size as the rotor planetates in the housing cavity. The rotor carries a sealing grid which includes apex seal assemblies, gas seal strips and a lubricant seal ring in at least one of its side faces. The lubricant seal ring is disposed to surround the rotor hub portion and functions to seal the interstices between the rotor side face and the adjacent end wall of the housing.

The lubrication metering system, according to this invention, is provided. The system includes means for supplying lubricant to the area adjacent the hub portion of the rotor. This means, for example, may include lubricant supply passages in the mainshaft and discharge outlets for directing lubricant into coolant passages formed in the rotor, as is shown in the U.S. Pat. to Bentele et al, U.S. Pat. No. 3,176,915 dated Apr. 6, 1965, or may comprise other means for supplying lubricant to oil-cooled rotors, such as exemplified in the U.S. patents to Froede et al, U.S. Pat. No. 3,876,345, dated Apr. 8, 1975; and Ruf, U.S. Pat. No. 3,705,570 dated Dec. 12, 1972.

The lubrication metering system, in addition to the supply means, comprises a by-pass passage means for conducting a predetermined small quantity of lubricant from the area adjacent the hub portion radially outwardly past the seal ring and into the interstices between the rotor side face and the adjacent housing end wall.

In a narrower aspect of the invention, the by-pass passage means is an elongated recess in the contact surface of the lubricant seal ring. This by-pass passage has a flow area which varies directly with the eccentricity of the Wankel mechanism and is within range of about 0.007 inch X (*e*) to about 0.013 inch X (*e*) where (*e*) is the eccentricity of the eccentric portion of the mainshaft which supports the rotor.

BRIEF DESCRIPTION OF THE DRAWINGS

The invention will be more fully understood from the following detailed description thereof when considered in connection with the accompanying drawing wherein an embodiment of the invention is illustrated by way of example, and in which:

FIG. 3 is an enlarged fragmentary view of a portion of the mechanism as shown in FIG. 2 and on an enlarged scale showing the lubricant seal ring and gas seal strip;

FIG. 4 is a view in cross-section taken along line 4—4 of FIG. 3 showing the lubricant metering system according to a first embodiment; and FIG. 5 is a cross-sectional view taken along line 5—5 of FIG. 4 and illustrated on a substantially increased scale.

DESCRIPTION OF PREFERRED EMBODIMENTS

Figure 2:
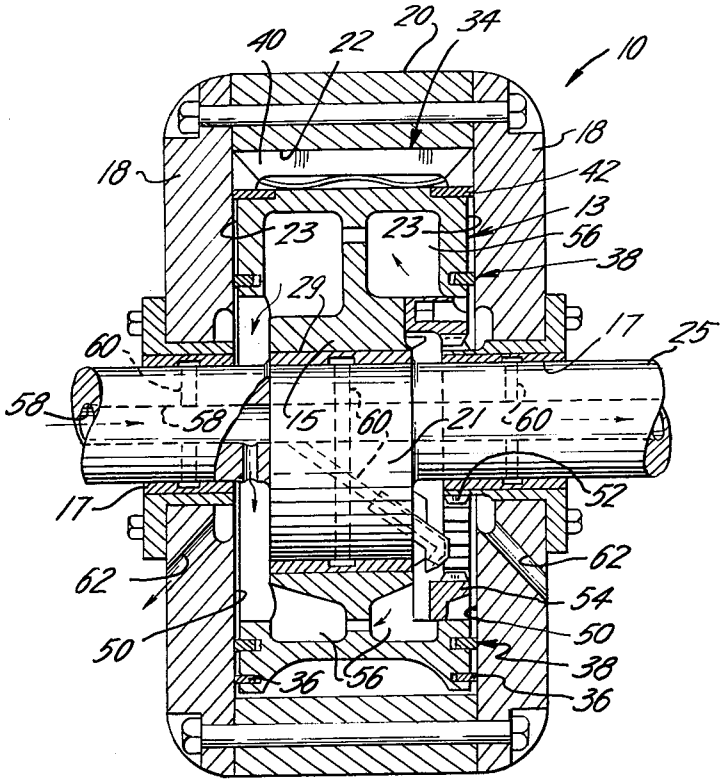
FIG. 2 is a cross-sectional view taken substantially along line 2—2 of FIG. 1.
Figure 1:
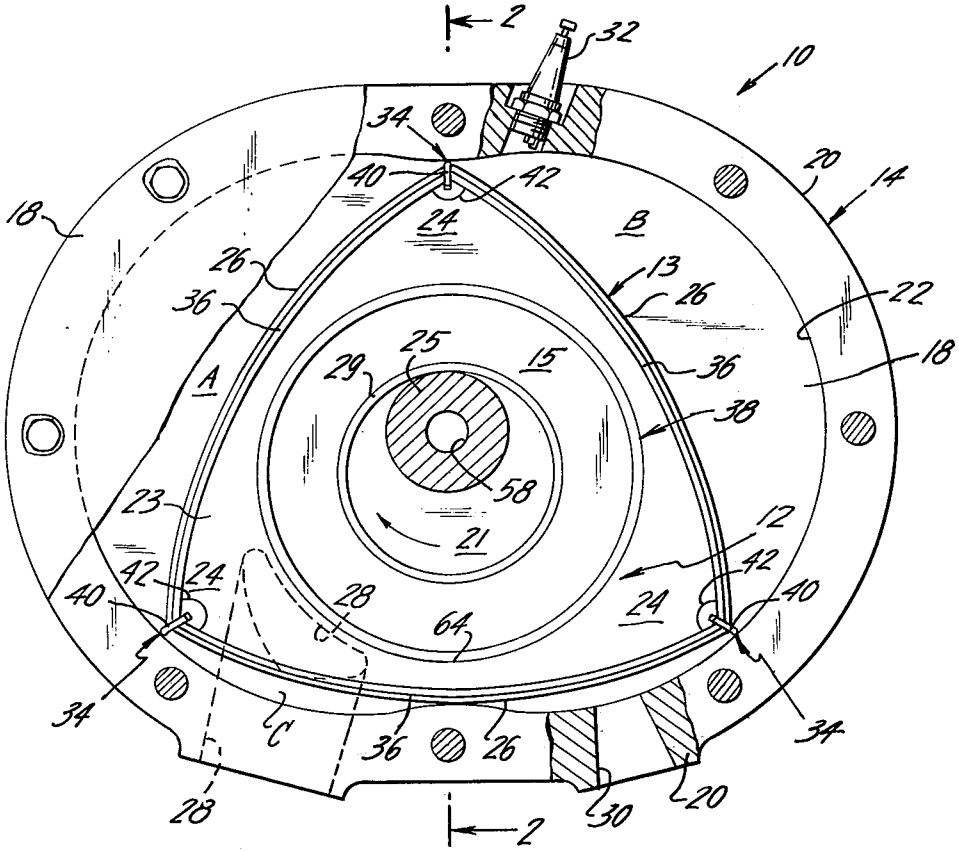
FIG. 1 is a transverse cross-sectional view through a rotary piston mechanism having the lubricant metering system according to this invention.

Now referring to the drawings, and more particularly FIGS. 1 and 2, the reference number 10 generally designates a rotary piston mechanism of the Wankel type such as disclosed in the U.S. patent to Wankel et al, U.S Pat. No. 2,988,065 dated June 13, 1961. The mechanism 10 is provided with the lubrication metering system 12, according to this invention. While mechanism 10 is shown and will be described as a rotary internal combustion engine, it is to be understood that the metering system 12 has application as well to expansion engines, pumps and compressors.

As illustrated, mechanism 10 comprises a rotor 13 which is supported eccentrically within a multi-lobe cavity formed by a housing 14. The housing 14 of a single rotor mechanism as shown, comprises two end walls 18 held in spaced relationship to each other by an intermediate wall 20 which has a trochoidal-shaped peripheral surface 22. The rotor 13 has one more apex portion than the number of lobes between the housing cavity so that, in the rotary mechanism illustrated, the rotor has two opposite, generally triangular-shaped faces 23 each of which has three apex portions 24, while the cavity has two lobes. The rotor has three peripheral surfaces or flanks 26 which define with the housing cavity, three working chambers A, B and C that successively expand and contract in volumetric size as rotor 13 planetates within housing 14. The rotor, at its hub portion 15, is supported on an eccentric portion 21 of a mainshaft 25 which is journaled for rotation in sleeve bearings 17 in end walls 18. A sleeve bearing 29 is interposed between hub portion 15 of rotor 13 and eccentric portion 21.

If, as shown, rotary mechanism 10 is an internal combustion engine, an inlet port 28 may be provided in one of the end walls 18 to admit a mixture of fuel and air into the working chambers. An exhaust port 30 may be provided in the intermediate wall 20 to pass spent products of combustion from the working chambers. An ignition means 32, such as a spark plug, is also provided to ignite the compressed fuel and air mixture so that the expanding gases rotatively drive rotor 13 in the clockwise direction as viewed in FIG. 1. To isolate each of the working chambers A, B and C from each other and the surrounding areas, rotor 13 carries a sealing grid.

The sealing grid may comprise, as is shown, apex seal assemblies 34 at each of the apex portions 24, gas seal strips 36 and a lubricant seal ring 38 in each rotor face 23 or may be of the type in which the apex seal assembly does not include an apex pin as disclosed in the U.S. patent to Griffith, U.S. Pat. No. 3,764,240 dated Oct. 9, 1973.

Each of the gas seal strips 36 may be of any suitable design, as for example, the gas seal strips disclosed in the U.S. patents to Bentele, U.S. Pat. No. 3,033,180 dated May 8, 1962; Simonsen, U.S. Pat. No. 3,139,233 dated June 30, 1964; and Silver, U.S. Pat. No. 3,834,845 dated Sept. 10, 1974.

Each of the apex seal assemblies 34 may be of any suitable design, such as disclosed in the U.S. patents to Anderson, U.S. Pat. No. 3,102,518 dated Sept. 3, 1963; Jones, U.S. Pat. No. 3,300,124 dated Jan. 24, 1967; Jones, U.S. Pat. No. 3,400,691 dated Sept. 10, 1968; and Paschke, U.S. Pat. No. 3,180,561 dated Apr. 27, 1965 and may comprise, as shown, a multi-blade sub-assembly 40 and apex pin 42.

As is best shown in FIG. 3, each of the seal rings 38 is disposed in an annular recess 44 in rotor face 23, the recess being radially spaced outwardly of rotor hub 15. A biasing means, such as an O-ring 46, is disposed in recess 44 behind the associated seal ring 38 to bias the latter in a direction outwardly of the recess and the contacting surface 48 of the seal ring into engagement with the adjacent inner surface 50 of end wall 18. The seal rings 38 function to prevent radially outwardly directed flow of oil from the area of hub portion 15 through the interstices between the rotor faces 23 and the inner surface 50 of end walls 18. This is particularly important where, as shown, large quantities of oil under a positive pressure induced by acceleration forces are supplied to the area of rotor hub portion 15 to lubricate bearings 17 and 29 and timing gears 52 and 54 and, as shown in the case of an oil-cooled rotor, for flow through the coolant passages 56. As shown, oil from an oil reservoir or sump (not shown) may be conducted through a supply passage 58 in mainshaft 25 to branch lines 60 from which the oil is discharged for lubrication and/or cooling. The oil is conducted from the mechanism 10 via discharge ports 62 in end walls 18 for recirculation and/or cooling. While flow of oil past ring seals 38 is to be prevented, it is desirable to lubricate the inner surfaces 50 of end walls 18 which are outward of the orbit of the ring seals and are engaged by gas seal strips 36 and apex seal assemblies 34. To accomplish this lubrication, and in some applications also the lubrication of trochoidal surface 22 which is engaged by the blades of the apex seal assemblies 34, the lubrication metering system 12 of this invention is provided.

In FIGS. 3, 4 and 5 is shown, on an enlarged scale, the lubrication metering system 12, according to this invention. As shown, a shallow, substantially radially extending by-pass recess or groove 64 is provided in the contacting surface 48 of each of the seal rings 38. This recess 64 may, as best shown in FIG. 5, be a V-shaped trough with the width W substantially equal to the depth *h*. For example, by-pass recess 64 for a mechanism 10 having one rotor and approximately a 60 cubic inch swept volume per mainshaft revolution, is from about 0.005 to 0.010 inches in width W and depth *h*. This provides the requisite oil supply for lubrication purposes without causing excessive oil introduction into working chambers A, B and C. More broadly, by-pass recess 64 may have any suitable cross-sectional configuration which is preferably sized to have a flow area which varies directly with the eccentricity of the eccentric portion 21 of mechanism 10 and still, more specifically, is sized to provide a flow area in the range of about 0.007 inches X (*e*) where (*e*) is the eccentricity of eccentric portion 21. Furthermore, while one recess is preferred and shown, it is within the scope and spirit of this invention to provide two recesses or more recesses 64 and where each recess has an appropriately reduced flow area relative to the flow area of the single recess 64.

It is believed now readily apparent that the present invention provides, in a rotary mechanism of the Wankel type, a relatively inexpensive and automatic means for metering oil to the inner surfaces of the housing of the mechanism.

Although only one embodiment of the invention has been illustrated and described in detail, it is to be expressly understood that the invention is not limited thereto. Various changes can be made in the arrangement of parts without departing from the spirit and scope of the invention as set forth in the appended claims and as the same will now be understood by those skilled in the art.

What is claimed is:

1. In a rotary mechanism having a housing comprising two end walls spaced apart by an intermediate wall having an inner peripheral surface of trochoidal shape and defining therebetween a multi-lobe cavity and having a rotor consisting of opposite side faces, a plurality of flank portions intersecting each other to form apex portions, and a hub portion, supported in the housing cavity at its hub portion on an eccentric portion of a mainshaft for planetary rotation and defining with the housing a plurality of working chambers which successively expand and contract in volumetric size as the rotor rotates in said cavity, the rotor carrying a seal grid, including seal strips and a lubricant seal ring located radially inwardly of the seal strips in at least one of the rotor side faces and surrounding the rotor hub portion, the seal ring having an outer peripheral contact surface engaging the adjacent housing end wall to seal the interstices between the rotor side face and the adjacent housing end wall, a lubrication metering system, including means for supplying lubricant to the area adjacent the hub portion of the rotor, comprising at least one recess in said outer peripheral contact surface of the seal ring for conducting a predetermined small quantity of lubricant from the interstices between the rotor side face and said adjacent end wall, in the area adjacent the hub portion, radially outwardly past the seal ring and into the interstices between the rotor side face said adjacent housing end wall in the area radially outwardly of the seal ring.

2. The apparatus of claim 1 wherein said recess is V-shaped in cross-section with a depth dimension substantially the same as the dimension of the width thereof.

3. The apparatus of claim 1 wherein said recess has a flow area within the range of about 0.007 inches, multiplied by (*e*) and about 0.013 inches multiplied by (*e*), wherein (*e*) is the amount of eccentricity of the eccentric portion of the mainshaft.

* * * * *